US005546622A

United States Patent [19]

McAlister et al.

[11] Patent Number: 5,546,622

[45] Date of Patent: Aug. 20, 1996

[54] FABRIC PROCESSING APPARATUS AND METHOD OF TREATING A CONTINOUS LENGTH OF TUBULAR-KNIT FABRIC IN TUBULAR FORM

[76] Inventors: Ronald E. McAlister, 3042 Foxborough Ct., Gastonia, N.C. 28056; Eddie L. Crafton, 12 Monroe Rd., Maiden, N.C. 28650; Ervin N. Keever, 4255 Barbrick St., Sherrills Ford, N.C. 28673

[21] Appl. No.: 271,009

[22] Filed: Jul. 5, 1994

[51] Int. Cl.[6] ..... D06B 3/32

[52] U.S. Cl. ..... 8/151; 68/9; 68/205 R

[58] Field of Search ..... 8/151; 68/205 R, 68/9

[56] References Cited

U.S. PATENT DOCUMENTS

| | | | |
|---|---|---|---|
| 1,769,702 | 7/1930 | London et al. . | |
| 1,979,818 | 11/1934 | Baker | 8/5 |
| 2,736,632 | 2/1956 | Blau | 8/142 |
| 3,412,411 | 11/1968 | Conn et al. | 8/151 |
| 3,505,004 | 4/1970 | Pfeil | 8/137 |
| 3,802,839 | 4/1974 | Stevens, Jr. | 8/151 |
| 3,922,738 | 12/1975 | Holm | 8/151 |
| 3,954,404 | 5/1976 | Childers et al. | 8/175 |
| 4,150,948 | 4/1979 | Aronoff et al. | 8/151 |
| 4,184,841 | 1/1980 | Diggle, Jr. | 8/151 |
| 4,376,632 | 3/1983 | Codecasa | 8/151 |
| 4,454,171 | 6/1984 | Diggle, Jr. et al. | 8/151 |
| 4,520,520 | 6/1985 | Johnston et al. | 8/151 |
| 4,788,732 | 12/1988 | Kollmar | 8/158 |
| 4,922,567 | 5/1990 | Miller | 8/151 |
| 4,947,501 | 8/1990 | Koch . | |

FOREIGN PATENT DOCUMENTS

| | | | |
|---|---|---|---|
| 485164 | 1/1950 | Canada | 8/151 |

*Primary Examiner*—Frankie L. Stinson
*Attorney, Agent, or Firm*—W. Thad Adams, III, P.A.

[57] ABSTRACT

The invention is a fabric processing apparatus and method for treating a continuous length of tubular-knit fabric in tubular form. The apparatus includes a fabric feed station located at an upstream end of the apparatus for feeding the length of tubular-knit fabric into the apparatus. The fabric feed station includes spreader brackets for transversely spreading the tubular-knit fabric to define a flat, double thickness continuous-length fabric web of uniform width. A wash station is downstream of the feed station for washing the fabric web with water. A fabric press station is downstream of the wash station, and includes upper and lower compression rollers for engaging opposite surfaces of the fabric web for squeezing the wash water from the fabric web. The lower rollers drive the fabric through the apparatus from an upstream end to a downstream end thereof.

26 Claims, 3 Drawing Sheets

FABRIC PROCESSING APPARATUS AND METHOD OF TREATING A CONTINOUS LENGTH OF TUBULAR-KNIT FABRIC IN TUBULAR FORM

TECHNICAL FIELD AND BACKGROUND OF THE INVENTION

This invention relates to a fabric processing apparatus, and a method of treating a continuous length of tubular-knit fabric in tubular form. The invention relates to a continuous operation, and is applicable for use in any existing textile environment for washing a length of uncut tubular-knit fabric.

Common techniques for processing tubular-knit fabric in tubular form involve batch operations for washing a predetermined length of fabric tube as a rope. According to one prior art technique, the fabric tube is twisted into a rope, and submerged in a wash bath which may include recycled or spent water which typically includes dye chemicals, resins, and other contaminants from previously washed fabrics. After dipping, the wet fabric rope is compressed to squeeze out the wash water. This technique generally results in uneven washing and stresses and strains in the fabric tube which may cause non-uniform shrinkage, crack marks, and abrasions.

Other prior art techniques apply lengthwise tension to the fabric tube during processing. Tension in the fabric stretches the fibers and yarns, and results in non-uniform shrinkage and uneven sizing.

The present invention overcomes these and other problems of prior art machines and processes for treating tubular knit fabric by providing an apparatus which washes a continuous length of uncut tubular fabric in a flat, double thickness sheet. Processing the fabric in flat form prevents crack marks, abrasions, and uneven washing which generally result from washing the fabric tube in rope form. In addition, the present invention does not submerge the fabric in unclean or recycled water, but instead, spray washes the entire surface area of the moving fabric web with fresh water. The continuous-length fabric web moves through the invention in a tensionless condition to ensure proper, uniform shrinkage and even sizing of the fabric in subsequent processing.

SUMMARY OF THE INVENTION

Therefore, it is an object of the invention to provide a fabric processing apparatus which washes a continuous length of tubular knit fabric in tubular form.

It is another object of the invention to provide a fabric processing apparatus which first spreads the fabric tube into a flat, double thickness fabric web prior to washing and flat pressing the fabric.

It is another object of the invention to provide a fabric processing apparatus which does not cause abrasions or crack marks in the fabric after washing.

It is another object of the invention to provide a fabric processing apparatus which uses fresh water for washing the length of tubular fabric.

It is another object of the invention to provide a fabric processing apparatus which spray washes the opposing outer surfaces of the fabric web during processing.

It is another object of the invention to provide a fabric processing apparatus which washes a length of fabric in a tensionless condition to thereby reduce linear growth of the fabric during processing.

It is another object of the invention to improve fabric compaction by reducing linear growth of the fabric during processing.

It is another object of the invention to provide a fabric processing apparatus which can be readily adapted for washing a continuous length of open-width fabric.

These and other objects of the present invention are achieved in the preferred embodiments disclosed below by providing a fabric processing apparatus for treating a continuous length of tubular-knit fabric in tubular form. The apparatus includes a fabric feed station located at an upstream end of the apparatus for feeding the length of tubular-knit fabric into the apparatus. The fabric feed station includes spreader means for transversely spreading the tubular-knit fabric to define a flat, continuous-length fabric web of uniform width for being moved downstream through the apparatus. A wash station is downstream of the feed station for washing the fabric web with water. A fabric press station is downstream of the wash station, and includes means for engaging opposite surfaces of the fabric web for squeezing the water from the fabric web. Conveyor means move the fabric through the apparatus from an upstream end to a downstream end thereof.

According to one preferred embodiment of the invention, the spreader means of the fabric feed station are first and second laterally-spaced spreader brackets for engaging and transversely spreading the tubular-knit fabric to form the fabric web.

According to another preferred embodiment of the invention, the wash station includes a plurality of high pressure spray heads communicating with a source of wash water for spray washing the opposite surfaces of the fabric web.

According to yet another preferred embodiment of the invention, the engaging means of the fabric press station are upper and lower compression rollers for receiving the fabric web therebetween, and for applying pressure to the opposite surfaces of the fabric web to squeeze the wash water from the fabric web.

According to yet another preferred embodiment of the invention, a second wash station is downstream of the fabric press station for further washing the fabric web with water.

According to yet another preferred embodiment of the invention, the second wash station includes a plurality of high pressure spray heads communicating with a source of water for spray washing the opposite surfaces of the fabric web with the wash water.

According to yet another preferred embodiment of the invention, a second fabric press station is downstream of the second wash station, and includes means for engaging opposite surfaces of the fabric web for squeezing the wash water from the fabric web.

According to yet another preferred embodiment of the invention, the engaging means of the second fabric press station are upper and lower compression rollers for receiving the fabric web therebetween, and for applying pressure to the opposite surfaces of the fabric web to squeeze the wash water from the fabric web.

According to yet another preferred embodiment of the invention, a third wash station is downstream of the second fabric press station for further washing the fabric web with water.

According to yet another preferred embodiment of the invention, the third wash station includes a plurality of high pressure spray heads communicating with a source of wash water for spraying the opposite surfaces of the fabric web with the wash water.

According to yet another preferred embodiment of the invention, the wash water of the third wash station is blended with a neutralizing acid.

According to yet another preferred embodiment of the invention, the third wash station includes a metering pump for controlling the flow rate of neutralizing acid into the wash water of the third wash station.

According to yet another preferred embodiment of the invention, a third fabric press station is downstream of the third wash station, and includes means for engaging opposite surfaces of the fabric web for squeezing the wash water from the fabric web.

According to yet another preferred embodiment of the invention, the engaging means of the third fabric press station are upper and lower compression rollers for receiving the fabric web therebetween, and for applying pressure to the opposite surfaces of the fabric web to squeeze the wash water from the fabric web.

According to yet another preferred embodiment of the invention, a fourth wash station is downstream of the third fabric press station for further washing the fabric web with water.

According to yet another preferred embodiment of the invention, the fourth wash station includes a plurality of high pressure spray heads communicating with a source of water for spray washing the opposite surfaces of the fabric web with the water.

According to yet another preferred embodiment of the invention, a fourth fabric press station is downstream of the fourth wash station, and includes means for engaging opposite surfaces of the fabric web for squeezing the wash water from the fabric web.

According to yet another preferred embodiment of the invention, the engaging means of the fourth fabric press station are upper and lower compression rollers for receiving the fabric web therebetween, and for applying pressure to the opposite surfaces of the fabric web to squeeze the wash water from the fabric web.

According to yet another preferred embodiment of the invention, the conveyor means includes a drive motor for driving the respective lower compression rollers of the first, second, third, and fourth fabric press stations to advance the fabric web in a lengthwise tensionless condition through the apparatus to a downstream end thereof.

According to yet another preferred embodiment of the invention, a fabric folding station is downstream of the fourth fabric press station for transversely folding the fabric web as the fabric web exits the apparatus at a downstream end thereof.

According to yet another preferred embodiment of the invention, a portable collection box is located downstream of the folding station for collecting and storing the fabric web therein in a folded condition after processing through the apparatus.

An embodiment of the method according to the invention includes the steps of feeding a length of tubular-knit fabric into a fabric processing apparatus at an upstream end thereof. The tubular fabric is then transversely spread to define a flat, continuous-length fabric web of uniform width for being moved downstream through the apparatus. The fabric web is washed with water, and then compressed on opposite surfaces thereof for squeezing the wash water from the fabric web. The fabric is then moved in a lengthwise tensionless condition through the apparatus from an upstream end to a downstream end thereof.

According to another preferred embodiment of the invention, the step of transversely spreading the tubular-knit fabric includes the step of providing first and second laterally-spaced spreader brackets in a fabric feed station of the apparatus for engaging and transversely spreading the tubular-knit fabric to form the fabric web.

According to another preferred embodiment of the invention, the steps of washing and compressing the fabric web include the step of passing the fabric web downstream of the feed station through a plurality of fabric wash stations and fabric press stations.

According to another preferred embodiment of the invention, the method includes the step of transversely folding the fabric web as the fabric web exits the apparatus at the downstream end thereof.

According to another preferred embodiment of the invention, the method includes the step of collecting the folded fabric web in a portable collection box.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
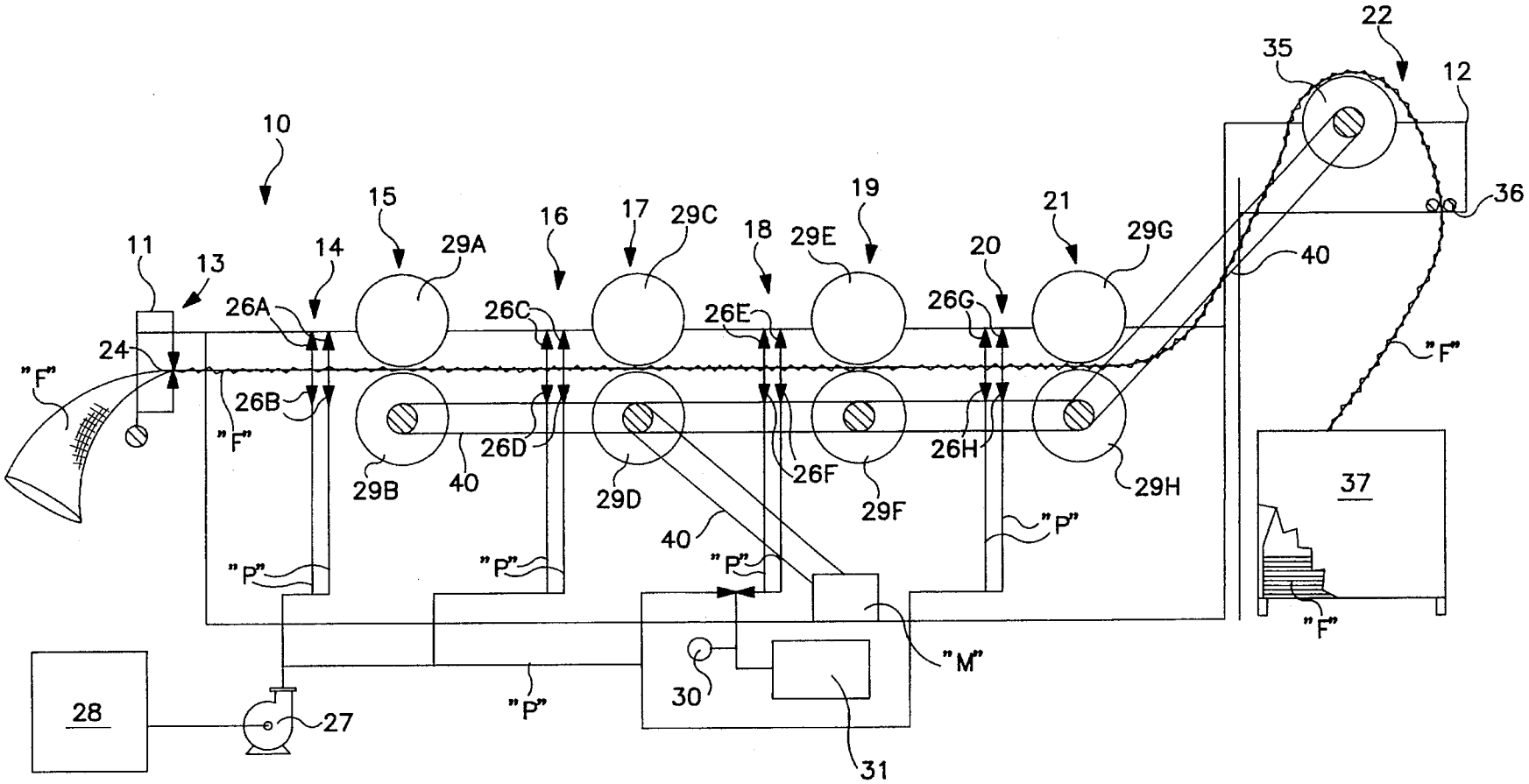
FIG. 1 is a side elevation of the invention according to one preferred embodiment.
Figure 2:
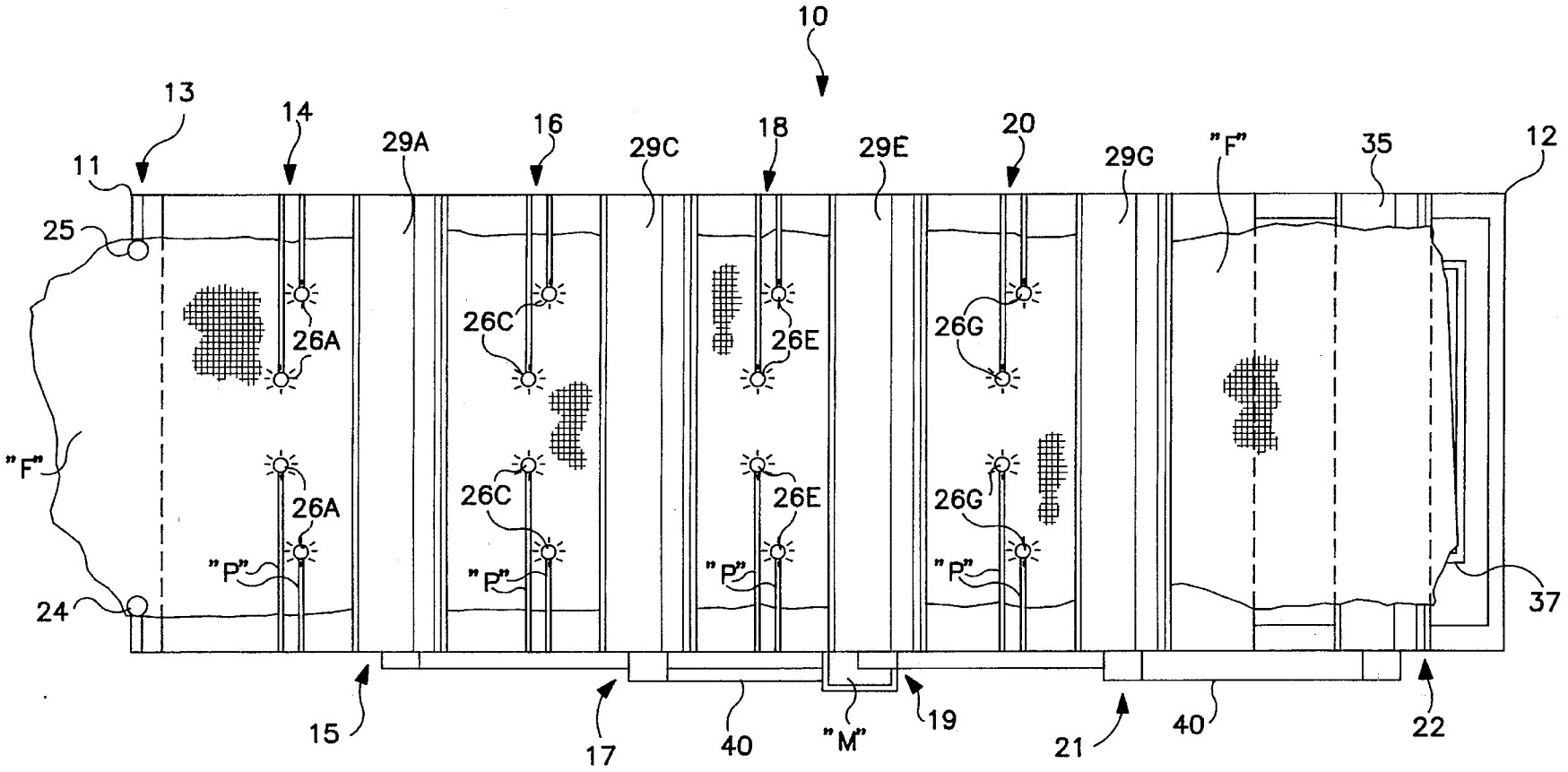
FIG. 2 is a top plan view of the invention according to the embodiment shown in FIG. 1.
Figure 3:
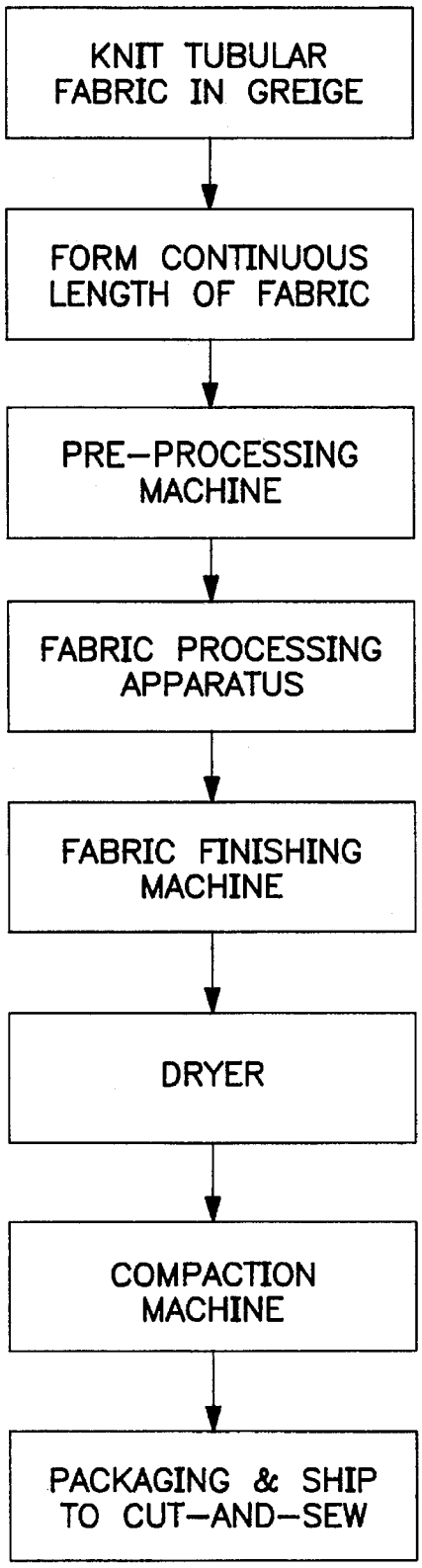
FIG. 3 is a flow diagram illustrating one exemplary application of the invention, and the general path of the fabric as it moves from the knitting machine to a cut-and-sew operation.

Referring now specifically to the drawings, a fabric processing apparatus according to the present invention is illustrated in FIGS. 1 and 2 and shown generally at reference numeral 10. The fabric processing apparatus 10 may be adapted for use in any existing textile operation for washing a length of tubular knit fabric. FIG. 3 is a flow diagram illustrating one exemplary application of the apparatus 10, and the general path of the fabric as it moves from the knitting machine to a cut-and-sew operation.

As indicated in FIG. 3, a fabric such as cotton is knitted on a conventional tubular knitting machine, and wound in greige form onto successive storage rolls. Each roll generally carries about 40 pounds of fabric. A length of fabric is then formed by sewing together the respective ends of about 15–20 fabric rolls. A fewer or greater number of rolls may be sewn together, as desired.

The resulting continuous length of fabric is flat-folded, or rolled, and placed in a portable holding box. The fabric is moved from the holding box to a pre-processing machine for high-white bleaching, dying, or scouring. The pre-processing machine may be a machine manufactured and used by Tube-Tex, Inc. of Lexington, N.C., and sold under the trademark Dye-Roll.

From the pre-processing machine, the length of fabric is sent to the fabric processing apparatus 10 of the present invention, as described in detail below. If the fabric has been cold dyed during pre-processing, the apparatus 10 washes out excess dye and other chemicals. In the case of scouring, the apparatus 10 removes bleaches and caustics, and neutralizes chemicals to prepare the fabric for subsequent hot-dye processing.

From the fabric processing apparatus 10, the length of fabric moves to a finishing machine, such as that manufactured and used by Tube-Tex, Inc., and sold under the trademark Tri-Pad. Similar fabric finishing machines are well known in the industry, and are used for applying surface finishes, softeners, and lubricants to the fabric. The fabric is thereafter dried, and sent to a fabric compaction machine for sizing and pre-shrinkage. From the compaction machine, the fabric is packaged and shipped to a cut-and-sew operation for fabrication into items such as knit apparel.

The Fabric Processing Apparatus

Referring now to FIGS. 1 and 2, a continuous length of tubular knit fabric "F" is processed in double thickness, web form through the apparatus 10 from an upstream end 11 to a downstream end 12 thereof. The term "continuous length" refers to any desired length of fabric formed by sewing together the ends of individual, pre-formed rolls of uncut tubular knit fabric. Thus, the process achieved by the apparatus 10 is a continuous process, capable of treating about 1000 pounds of fabric per hour.

As shown in FIGS. 1 and 2, the fabric processing apparatus 10 includes a fabric feed station 13, a plurality of fabric wash stations 14, 16, 18, and 20 and fabric press stations 15, 17, 19 and 21, and a fabric folding station 22. Prior to entering the apparatus 10, any inherent twist in the tubular knit fabric "F" may be removed by means of a hydraulic or electric turntable (not shown). A leader cloth is preferably attached to the length of fabric "F", and threaded through apparatus 10 to initiate processing.

The fabric feed station 13 is located at the upstream end 11 of the apparatus 10, and includes laterally spaced spreader brackets 24 and 25 for engaging the tubular fabric "F" and transversely spreading the fabric "F" to define a flat, double thickness fabric web of uniform width. Preferably, each of the spreader brackets 24 and 25 are 3-inch Teflon-covered spreader brackets which do not pierce or otherwise damage the side edges of the moving fabric web "F" during processing. These type of brackets are common in the industry.

After spreading, the fabric web "F" is moved downstream in a lengthwise tensionless condition to a first wash station 14 and first fabric press station 15. The first wash station 14 includes a plurality upper and lower high-pressure spray heads 26A and 26B for spraying the opposing outer surfaces of the fabric "F" with wash water. Each of the upper and lower spray heads 26A and 26B sprays approximately 2 gallons of water per minute through a 10–80 degree spray angle. Preferably, the first wash station 14 includes between 4–12 upper spray heads 26A, and between 4–12 corresponding lower spray heads 26B.

As shown in FIG. 1, the upper and lower spray heads 26A and 26B are operatively connected through piping "P" with a supply pump 27 and source of fresh water 28. The term "fresh" refers to water which is not collected after use and recycled. Preferably, the temperature of the water in the first wash station 14 is approximately 180 degrees F.

The first fabric press station 15 is located downstream of the first wash station 14, and includes upper and lower compression rollers 29A and 29B positioned for receiving the moving fabric web "F" therebetween. The compression rollers 29A and 29B engage the opposing outer surfaces of the fabric web "F", and operate to squeeze out the wash water remaining in the fabric web "F" after spray washing in the first wash station 14. Preferably, the upper compression roller 29A is connected to an air cylinder, shaft, and take-up bearing (not shown) for applying a downward force on the upper roller 29A of approximately 150 psi. The vertical position of the lower compression roller 29B is fixed throughout processing. According to one embodiment, the rollers 29A and 29B are each 60 inch wide, 80 durometer urethane rollers commonly used in the industry.

A second wash station 16 and second fabric press station 17 are located downstream of the first press station 15 for further washing and flat pressing the outer surfaces of the moving fabric web "F". The second wash station 16 includes a plurality of upper and lower high-pressure spray heads 26C and 26D communicating through piping "P" with the pump 27 and source of wash water 28, as described above. Preferably, the number, orientation, and spray rate of the upper and lower spray heads 26C and 26D of the second wash station 16 are identical to that described above with reference to the first wash station 14. The wash water is preferably 180 degree F. fresh water.

The second fabric press station 17 is located downstream of the second wash station 16, and includes upper and lower compression rollers 29C and 29D identical to those described above with reference to the first press station 15. The compression rollers 29C and 29D engage the opposing outer surfaces of the moving fabric web "F" and operate to squeeze out the wash water remaining in the fabric web "F" after spray washing in the second wash station 16.

A third fabric wash station 18 and press station 19 are located downstream of the second press station 17. The third wash station 18 is preferably identical to the first and second wash stations 14 and 16, including a plurality upper and lower high-pressure spray heads 26E and 26F for spraying the moving fabric web "F" with the wash water.

The wash water of the third wash station 18 is preferably blended with a neutralizing acid, such as acetic acid. As shown in FIG. 1, a metering pump 30 communicates with a source of neutralizing acid 31 to control the flow rate of acid into the stream of wash water moved through the piping "P". The metering pump 30 allows the machine operator to monitor and adjust the pH of the blended solution, as desired. Preferably, the wash water of the third rinse station is 150 degree F. fresh water.

The third fabric press station 19 is located downstream of the third wash station 18, and includes upper and lower compression rollers 29E and 29F identical to those described above with reference to the first and second press stations 15 and 17. The compression rollers 29E and 29F engage the opposing outer surfaces of the moving fabric web "F", and operate to squeeze out the wash water remaining in the fabric web "F" after spray washing in the third wash station 18.

A fourth wash station 20 and fourth fabric press station 21 are located downstream of the third press station 19. The fourth wash station 20 includes a plurality of upper and lower high-pressure spray heads 26G and 26H communicating through piping "P" with the pump 27 and source of wash water 28, as described above with reference to the first and second wash stations 14 and 16. The wash water of fourth wash station 20 is preferably 100 degree F. fresh water.

The fourth fabric press station 21 is located downstream of the fourth wash station 20, and includes upper and lower compression rollers 29G and 29H identical to those described above with reference to the first, second, and third press stations 15, 17, and 19. The compression rollers 29G and 29H engage the opposing outer surfaces of the moving fabric web "F", and operate to squeeze out the wash water remaining in the fabric web "F" after spray washing in the fourth wash station 20.

From the fourth press station 21, the fabric web "F" moves downstream over an elevated felt roller 35 to the fabric folding station 22 located at the downstream end 12 of the apparatus 10. The fabric folding station 22 includes a standard platter-type folder 36 and portable collection box 37. The platter-type folder 36 may be chain or pulley-driven, and reciprocates along a horizontal plane to impart about a 36 inch (90 cm) fold in the moving fabric web "F" as the fabric web "F" exists the apparatus 10 and falls into the collection box 37. After processing through the apparatus 10, the fabric "F" is evenly washed without crack marks or abrasions, and is ready for further processing in a fabric finishing machine, dye bath, or other desired operation.

Preferably, the fabric "F" moves through the apparatus 10 at approximately 10–70 yards per minute, with thicker fabrics moving at a slower rate to ensure complete processing. Each of the lower compression rollers 29B, 29D, 29F, 29H and the felt roller 35 are preferably driven by a single DC motor "M" through a chain or pulley assembly 40, or a gear drive (not shown). The rollers 29B, 29D, 29F, 29H and the felt roller 35 rotate at identical speeds so that the moving fabric web "F" remains in a tensionless condition throughout processing.

Although not shown, the apparatus 10 preferably includes a removable transparent cover, side walls, and end walls to contain the sprayed wash water within the apparatus 10. One or more portable water collection trays (also not shown) may be placed beneath the spray heads 26A–H to collect the spent water for disposal.

In addition, the apparatus 10 may be modified, as desired, to include additional feed stations, wash and press stations, and folding stations to run two or more lengths of tubular knit fabric side by side. Moreover, the apparatus 10 may include additional or fewer successive wash and press stations depending upon the particular application, and needs of the machine owner.

A fabric processing apparatus and method of treating a continuous length of tubular-knit fabric in tubular form is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A fabric processing apparatus for treating a continuous length of tubular-knit fabric in tubular form, said apparatus comprising:

(a) a fabric feed station located at an upstream end of said apparatus for feeding the length of tubular-knit fabric into said apparatus, and including spreader means for transversely spreading the tubular-knit fabric to define a flat, double thickness continuous-length fabric web of uniform width for being moved downstream through said apparatus;

(b) a wash station downstream of said feed station for washing said flat fabric web with water;

(c) a fabric press station downstream of said wash station, and including means for engaging opposite surfaces of said flat fabric web for squeezing the wash water from said fabric web; and (d) conveyor means for moving said flat fabric web in a lengthwise tensionless condition through said apparatus along a substantially linear path through the feed station, wash station, and fabric press station from an upstream end to a downstream end of said apparatus.

2. A fabric processing apparatus according to claim 1, wherein said spreader means of the fabric feed station includes first and second laterally-spaced spreader brackets for engaging and transversely spreading said tubular-knit fabric to form the double thickness fabric web.

3. A fabric processing apparatus according to claim 1, wherein said wash station includes a plurality of high pressure spray heads communicating with a source of wash water for spray washing the opposite surfaces of said fabric web.

4. A fabric processing apparatus according to claim 1, wherein said engaging means of the fabric press station includes upper and lower compression rollers for receiving the fabric web therebetween, and for applying pressure to the opposite surfaces of said fabric web to squeeze the wash water from said fabric web.

5. A fabric processing apparatus according to claim 1, and including a second wash station downstream of said fabric press station for further washing said fabric web with water.

6. A fabric processing apparatus according to claim 5, wherein said second wash station includes a plurality of high pressure spray heads communicating with a source of wash water for spray washing the opposite surfaces of said fabric web.

7. A fabric processing apparatus according to claim 5, and including a second fabric press station downstream of said second wash station, and including means for engaging opposite surfaces of said fabric web for squeezing the wash water from said fabric web.

8. A fabric processing apparatus according to claim 7, wherein said engaging means of the second fabric press station includes upper and lower compression rollers for receiving the fabric web therebetween, and for applying pressure to the opposite surfaces of said fabric web to squeeze the wash water from said fabric web.

9. A fabric processing apparatus according to claim 7, and including a third wash station downstream of said second fabric press station for further washing said fabric web with water.

10. A fabric processing apparatus according to claim 9, wherein said third wash station includes a plurality of high pressure spray heads communicating with a source of wash water for spray washing the opposite surfaces of said fabric web.

11. A fabric processing apparatus according to claim 10, wherein the wash water of said third wash station is blended with a neutralizing acid.

12. A fabric processing apparatus according to claim 11, wherein said third wash station includes a metering pump for controlling the flow rate of neutralizing acid into the wash water of the third wash station.

13. A fabric processing apparatus according to claim 9, and including a third fabric press station downstream of said third wash station, and including means for engaging opposite surfaces of said fabric web for squeezing the wash water from said fabric web.

14. A fabric processing apparatus according to claim 13, wherein said engaging means of the third fabric press station includes upper and lower compression rollers for receiving the fabric web therebetween, and for applying pressure to the opposite surfaces of said fabric web to squeeze the wash water from said fabric web.

15. A fabric processing apparatus according to claim 13, and including a fourth wash station downstream of said third fabric press station for further washing said fabric web with water.

16. A fabric processing apparatus according to claim 15, wherein said fourth wash station includes a plurality of high pressure spray heads communicating with a source of water for spray washing the opposite surfaces of said fabric web.

17. A fabric processing apparatus according to claim 15, and including a fourth fabric press station downstream of said fourth wash station, and including means for engaging opposite surfaces of said fabric web for squeezing the wash water from said fabric web.

18. A fabric processing apparatus according to claim 17, wherein said engaging means of the fourth fabric press station includes upper and lower compression rollers for receiving the fabric web therebetween, and for applying pressure to the opposite surfaces of said fabric web to squeeze the wash water from said fabric web.

19. A fabric processing apparatus according to claim 18, wherein said conveyor means comprises a drive motor for rotating the respective lower compression rollers of the first, second, third, and fourth fabric press stations to advance said fabric web in a lengthwise tensionless condition through said apparatus to a downstream end thereof.

20. A fabric processing apparatus according to claim 18, and including a fabric folding station downstream of said fourth fabric press station for transversely folding said fabric web as said fabric web exits said apparatus at a downstream end thereof.

21. A fabric processing apparatus according to claim 20, and including a portable collection box located downstream of said folding station for collecting and storing said fabric web therein in a folded condition after processing through said apparatus.

22. A method of treating a continuous length of tubular-knit fabric in tubular form, said method comprising the steps of:

(a) feeding the length of tubular-knit fabric into a fabric processing apparatus at an upstream end thereof;

(b) transversely spreading the tubular-knit fabric to define a flat, double thickness continuous-length fabric web of uniform width for being moved downstream through said apparatus;

(c) washing said flat fabric web with water;

(d) flat pressing said flat fabric web on opposite surfaces thereof for squeezing the wash water from said fabric web; and (e) moving said flat fabric web in a lengthwise tensionless condition through said apparatus from an upstream end to a downstream end thereof, and along a substantially linear path during feeding, washing, and pressing of the fabric.

23. A method according to claim 22, wherein the step of transversely spreading the tubular-knit fabric comprises the step of providing first and second laterally-spaced spreader brackets in a fabric feed station of the apparatus for engaging and transversely spreading the tubular-knit fabric to form the double thickness fabric web.

24. A method according to claim 23, wherein the steps of washing and flat pressing the fabric web comprise the step of passing the fabric web downstream of said feed station through a plurality of fabric wash stations and fabric press stations.

25. A method according to claim 22, and including the step of transversely folding said fabric web as said fabric web exits the apparatus at the downstream end thereof.

26. A method according to claim 25, and including the step of collecting the folded fabric web in a portable collection box.

* * * * *